US006092389A

United States Patent [19]

Jodet

[11] Patent Number: 6,092,389

[45] Date of Patent: Jul. 25, 2000

[54] HIGH RATE COOLING FURNACE FOR METAL STRIPS

[75] Inventor: Gérard Jodet, Saint Maur, France

[73] Assignee: Stein Heurtey, Ris-Orangis, France

[21] Appl. No.: 09/172,043

[22] Filed: Oct. 14, 1998

[30] Foreign Application Priority Data

Oct. 15, 1997 [FR] France ..... 97 12906

[51] Int. Cl.[7] ..... F25D 25/00; F24F 3/16; C21D 1/613; C21D 6/00

[52] U.S. Cl. ..... 62/378; 62/78; 148/634; 148/644

[58] Field of Search ..... 62/64, 378, 78; 148/625, 633, 634, 644

[56] References Cited

U.S. PATENT DOCUMENTS

| | | | |
|---|---|---|---|
| 4,398,700 | 8/1983 | Thome | 266/111 |
| 4,836,774 | 6/1989 | Harada et al. | 432/8 |
| 5,137,586 | 8/1992 | Klink | 148/529 |

*Primary Examiner*—William Doerrler
*Attorney, Agent, or Firm*—Pollock, Vande Sande & Amernick

[57] ABSTRACT

In an apparatus that rapidly cools heat treated metal strips with a recirculating nitrogen-hydrogen cooling gas mixture having a hydrogen content which ranges between 15%–50%, and a recirculation circuit for the gas mixture having a fan for creating a flow though recirculation ducts connected, through expandable compensator corrugations, upstream to at least one gas/water exchanger, a safety system operates with the exchanger. The safety system includes a housing having a main flow area upstream of the exchanger and into which recirculating cooling gas flows. A first register is interposed across the main flow area for selectively switching between open and closed states thereby passing or blocking flow through a major portion of the main flow area. At least one bypass flow area is defined within the housing and located adjacent the main flow area. A second register is interposed across the bypass flow area for selectively switching between open and closed states thereby passing or blocking flow through the bypass area. Respective sensors react to a break in the strip or the corrugation, or an interruption of power, and actuators rapidly respond to a plurality of dangerous conditions for activating the sensing means and for switching the first and second registers in accordance with the particular dangerous conditions.

14 Claims, 3 Drawing Sheets

HIGH RATE COOLING FURNACE FOR METAL STRIPS

FIELD OF THE INVENTION

The present invention relates to the improvements made to rapid-cooling ovens for materials in strip form and more particularly for metal strip. These ovens may especially form part of plants for treatments such as, for example, heat treatments on metal products in strip form, especially those for galvanizing, for annealing, for tinplate production, etc.

BACKGROUND OF THE INVENTION

Plants are known (EP-A-0,795,616) which are intended for the continuous heat treatment of metal strip, in which the strip to be treated travels through an oven consisting of a plurality of heat-treatment sections, especially heating sections, temperature-hold sections, annealing sections, cooling sections, etc. In this publication, the present proprietor has recommended the use of heating and/or cooling enclosures or chambers in which there is an atmosphere consisting of a hydrogen-based gas mixture, the hydrogen content of which is greater than the values usually permitted so as to increase the cooling rate. Thus, according to this prior technique, a gas mixture, especially a nitrogen/hydrogen gas mixture, having a hydrogen content which is greater than 15% and which may reach 50%, i.e. greater than the explosibility limit value for this gas, may be used as the atmosphere in the cooling enclosure.

In the cooling enclosure of the abovementioned plants, the recycled atmosphere gas is blown onto the continuously moving metal strip, after it has been cooled especially with the aid of gas/water heat exchangers, the composition of the atmosphere gas, and more particularly its high hydrogen content, making it possible to obtain very rapid cooling rates of the order of 100° C. per second. The plants therefore comprise a circuit of ducts for recirculating the $N_2$, $H_2$ atmosphere gas, one or more fans for continuously circulating this atmosphere gas in the recirculation ducts, and gas/water exchangers.

Given the very high hydrogen content of the atmosphere gas used during the rapid cooling, it is necessary to take great precautions to ensure that the plant is safe; indeed, a leak, however tiny, of the atmosphere gas into the environment cannot be tolerated.

The present invention aims to provide a solution to this safety problem, especially by taking into account the three following main phenomena which can impair this safety:

1) it may happen that the strip breaks inside the oven and, more particularly, in the rapid-cooling chamber. In this case, the atmosphere gas contracts, this being caused directly by the interruption in the heat supplied by the strip and the continuity of the gas/water exchange through the exchanger or exchangers. This atmosphere-gas contraction phenomenon results in a sudden depressurization in the rapid-cooling chamber and in the oven;
2) the assembly of ducts for circulating the atmosphere gas includes compensators which allow the ducts to expand. In the event of a break in a corrugation of a compensator, it is absolutely necessary to prevent air from getting into the atmosphere-gas recirculation circuit or any leakage of this gas into the environment; and
3) during a break in the power supply to the plant or during a general failure of the supply mains for the factory where this plant is located, it is necessary to stop recirculation of the atmosphere gas immediately.

The present invention solves the abovementioned problems by providing means making it possible, on the one hand, to prevent the atmosphere gas from passing through the exchanger or exchangers, i.e. preventing too rapid a cooling of this atmosphere gas, thereby avoiding a sudden depressurization in the oven should the strip break and, on the other hand, to stop, in a very short time, i.e. less than five seconds, the recirculation of the atmosphere gas in the rapid-cooling chamber, during a break in the corrugations of a compensator or during a break in the power supply.

Consequently, the present invention relates to a rapid-cooling oven, which may form part of a plant comprising various treatment stations, especially stations for the heat treatment of products in strip form, through which a metal strip runs continuously, the rapid cooling being obtained by spraying onto the strip a jet of atmosphere gas consisting of a nitrogen/hydrogen mixture having a hydrogen content which is greater than 15%, and preferably close to 50%, the atmosphere gas being recirculated using a circuit of recirculation ducts comprising at least one fan and at least one gas/water exchanger, the various ducts comprising compensators made in the form of a series of corrugations allowing all the ducts to expand, this oven being characterized in that the enclosure, in which the said exchanger or exchangers are housed and into which the atmosphere-gas recirculation ducts emerge, comprises:

- a main flow area via which the cooling gas flows through the said exchangers, this flow area being provided with a register upstream of the said exchanger or exchangers;
- bypass flow areas allowing the flow of cooling gas to be diverted in the event of the main flow area being closed, so that this flow does not pass through the said exchanger or exchangers, the said bypass flow areas being provided with registers; and
- actuators with a very short response time, i.e. less than five seconds, these being tripped by means for detecting a break in the strip, a break in a compensator corrugation and a break in the power supply.

According to one embodiment of the invention, the actuators, which are preferably pneumatic, are tripped by a sensor which detects any variation in the tension in the strip.

According to another embodiment of this invention, the actuators are tripped by a sensor which detects any variation in the pressure in the rapid-cooling chamber.

According to the present invention, means designed and produced so as to allow the rotation of the fan or fans to be stopped in a very short time are also provided, it being possible to produce these means by coupling the fan to a generator to which it is coupled either in the event of a break in a corrugation of a compensator or in the event of a break in the power supply.

Other features and advantages of the present invention emerge from the description given below with reference to the appended drawings which illustrate an embodiment thereof, given solely by way of example.

DETAILED DESCRIPTION OF THE INVENTION

Figure 1:
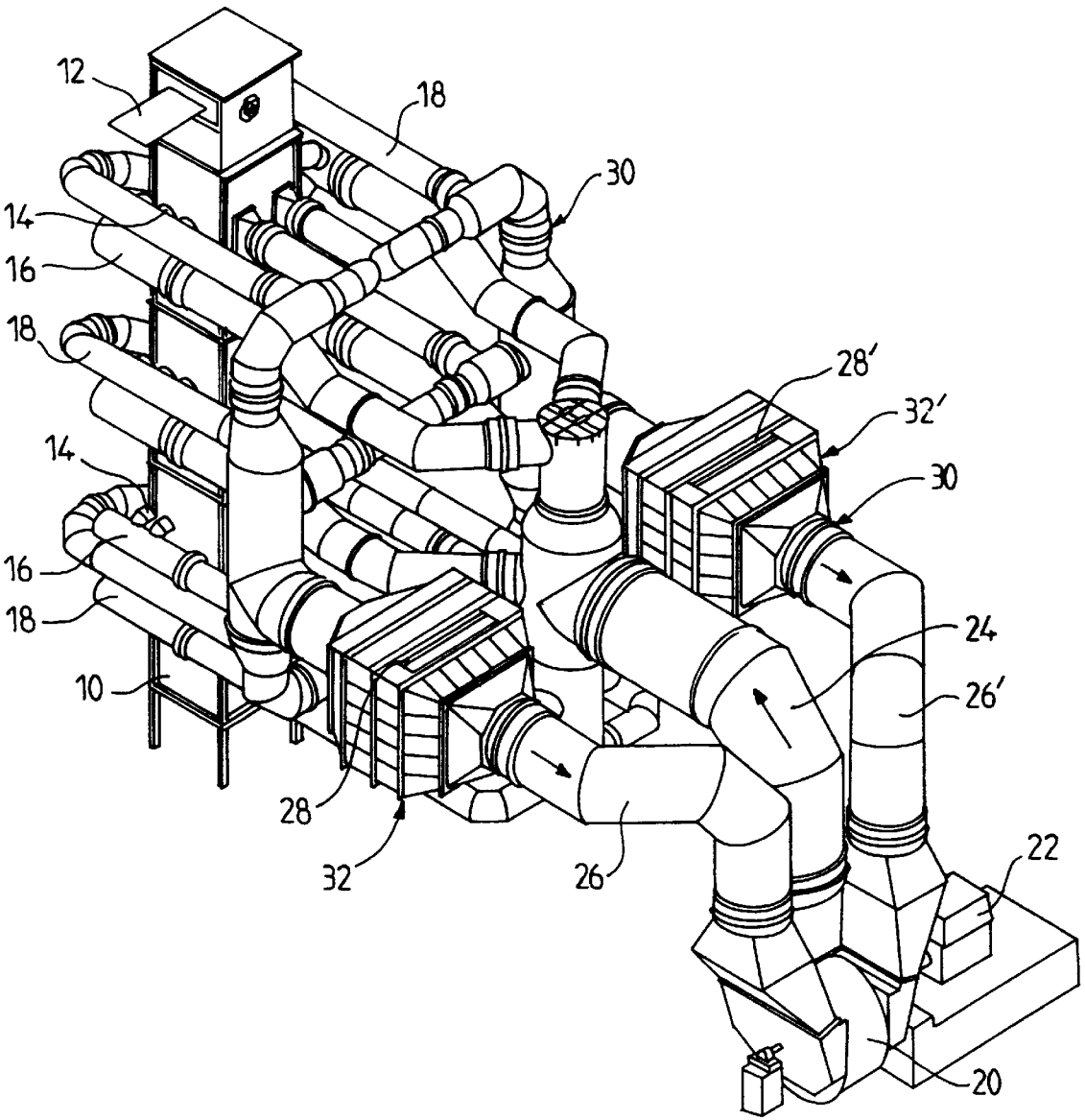
FIGS. 1 and 2 are perspective views illustrating an example of an embodiment of a rapid-cooling oven with its ducts for blowing and recirculating the atmosphere gas.
Figure 2:
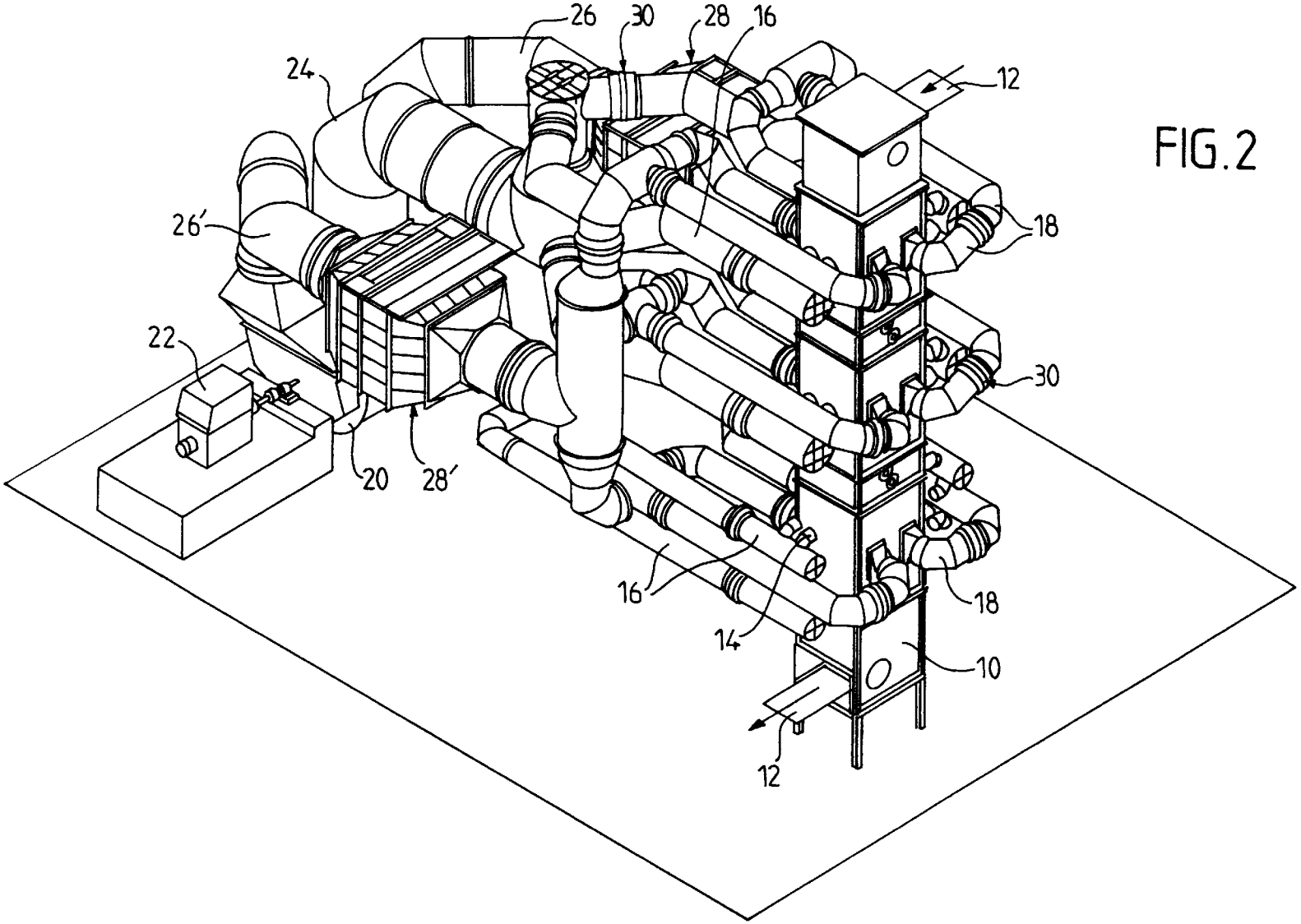

Referring to FIGS. 1 and 2, these show an overall view of a rapid-cooling oven to which the present invention applies.

This cooling oven or chamber generally forms part of a plant comprising a plurality of stations for the treatment of material in strip form, this plant possibly being, for example, of the type described in EP-0,795,616 mentioned above. Running continuously through this oven, denoted by the reference 10, is the metal strip 12, this strip generally coming from other treatment enclosures, for example for heat treatment, temperature-hold treatment, annealing treatment, etc.

The rapid cooling is obtained by spraying onto the strip 12, as a continuous flow, a jet of $N_2/H_2$ atmosphere gas containing, as explained above, a high proportion of hydrogen, which is greater than 15% and which may be as much as 50%. This atmosphere gas is sprayed onto the side faces of the strip 12 via nozzles, such as 14, supplied by ducts, such as 16, and it is recovered using ducts such as 18 which emerge parallel to the plane of the strip 12 in the rapid-cooling chamber 10. The atmosphere gas is circulated using a fan, such as 20, driven by an electric motor 22, the atmosphere gas being blown in via a manifold duct 24 supplying the ducts 14 while this atmosphere gas is recovered via the manifold ducts 26, 26' supplied by the ducts 18.

In a known manner, the plant furthermore comprises exchangers 28, 28', preferably of the gas/water type, which are housed in enclosures denoted in their entirety by the reference 32, 32', respectively, into which the atmosphere-gas recovery ducts 26, 26' emerge, so as to cool this atmosphere gas after it has flowed through the rapid-cooling chamber 10 and before it is recovered by the fan 20 and blown through the ducts 24 and 16. According to one construction, also known, the various ducts 16, 18, 24, 26, 26' comprise compensators 30 made in the form of a series of corrugations allowing all the ducts to expand.

Figure 4:
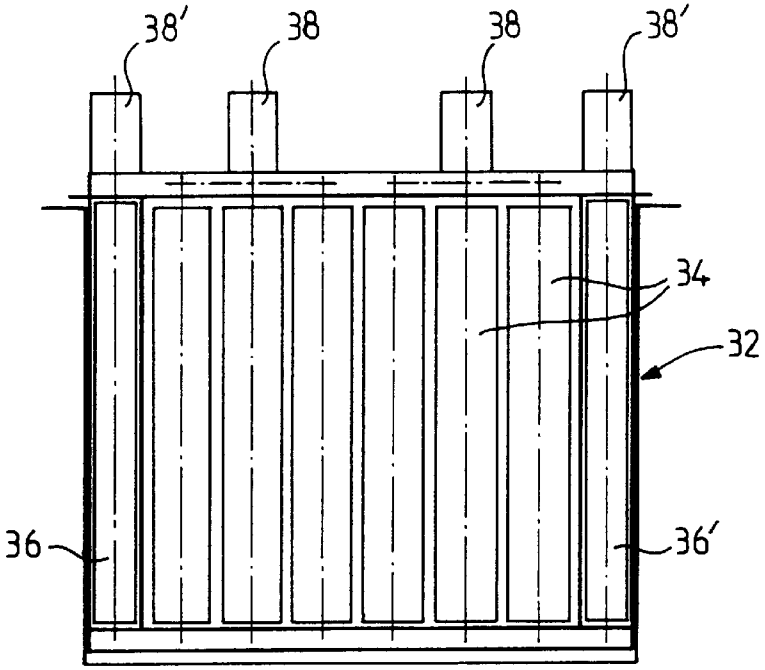
FIG. 4 is a section on IV—IV in FIG. 3.
Figure 3:
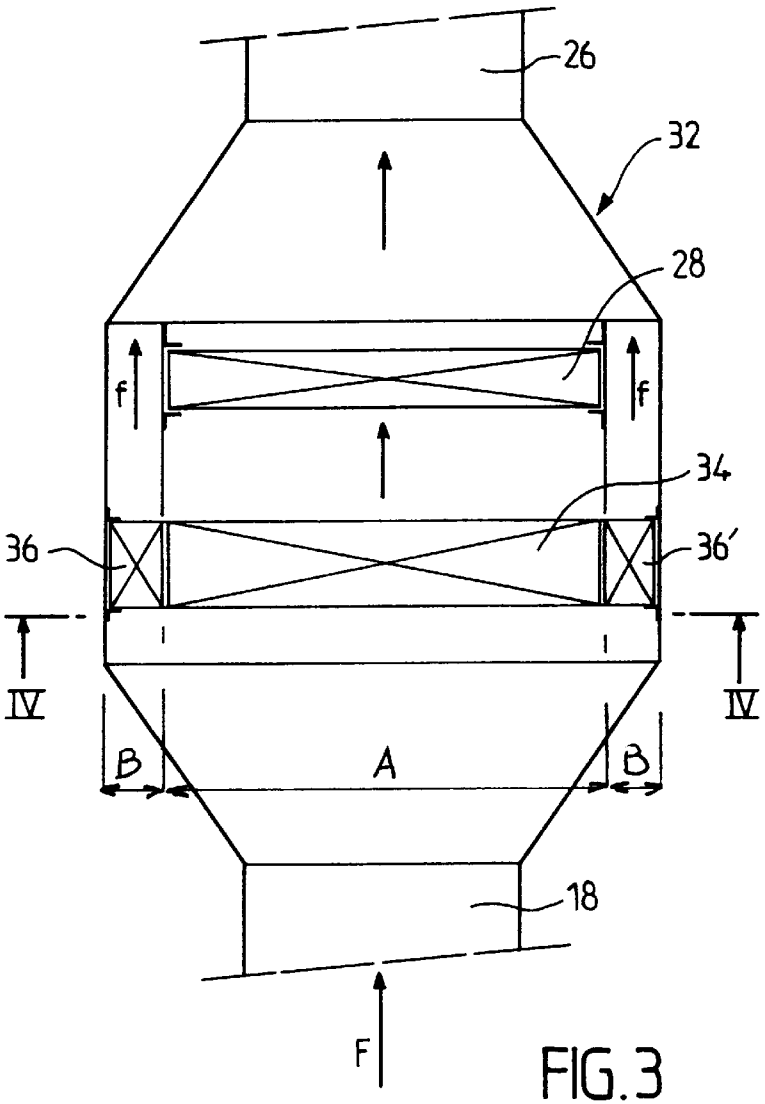
FIG. 3 is a diagrammatic plan view illustrating the improvements made by the present invention.

Referring now to FIGS. 3 and 4, these illustrate diagrammatically the improvements made by the invention. These figures show, in plan and in section respectively, an enclosure, such as 32 or 32' (FIGS. 1 and 2) housing a heat exchanger, such as 28, 28' in FIGS. 1 and 2. The direction in which the cooling gas recirculates has been shown by the arrow F, this gas coming from the ducts 18 and being sucked out through the duct 26 by the fan 20.

The flow through the exchanger 28 takes place via that area of the enclosure denoted by the reference A, this area being termed hereafter the main flow area.

According to the present invention, this main flow area A includes, upstream of the exchanger 28, a register, shown diagrammatically at 34, and provision is made for there to be bypass flow areas, denoted by the references B, these also being provided with registers, such as 36, 36', through which the flow of circulating cooling gas may be diverted so that it no longer passes through the exchangers such as 28, 28', as will be explained below (arrows f). The various registers 34, 36, 36' are controlled by actuators, preferably of the pneumatic type, such as 38, 38', having a very short response time, i.e. of less than 5 seconds.

Tripping these actuators, as will be explained below, makes it possible either to interrupt the flow of cooling gas through the main flow area A, i.e. through the exchangers such as 28, 28', and to divert this flow through the bypass flow areas B (register 34 closed and registers 36, 36' open) or to interrupt any flow of cooling gas through the flow areas A and B (registers 34, 36, 36' closed).

With reference to the three abovementioned operating incidents or phenomena, it is possible to draw up the table below which summarizes the various operating modes.

| DESCRIPTION | DIRECTION OF FLOW OF THE COOLING GAS | | |
|---|---|---|---|
| Flow area | B | A | B |
| Normal operation situation | Closed | Open | Closed |
| First phenomenon situation | Opening the registers 36, 36' | Closing the register 34 | Opening the registers 36, 36' |
| Second phenomenon situation | Closed | Closing the register 34 | Closed |
| Third phenomenon situation | Closed | Closing the register 34 | Closed |

According to the invention, the first phenomenon, i.e. a break in the strip, may be detected using a sensor which measures the tension in the strip, any variation in this tension from a set value resulting in the actuators controlling the closing of the main flow area A and the opening of the bypass flow areas B being tripped. It is also possible, for the same purpose, to provide a pressure sensor placed, for example, in the rapid-cooling chamber 10, any depressurization detected in this chamber resulting in the actuators being immediately actuated, as mentioned above. The latter means may also be used to detect a break in a corrugation of a compensator 30 so as to close the flow area A immediately, the bypass areas B being kept closed, as indicated in the above table.

Finally, any conventional means may be used to actuate the actuators 38 in the event of an interruption in the power supply, especially switches which trip by a break or fault in the current so as to cause the main flow area A to be immediately closed, the bypass flow areas B remaining closed.

According to the present invention, means may also be provided which allow the rotation of the fan 20 to be stopped in a very short time, for example by coupling it to a generator, to which it is coupled either in the event of a break in a corrugation of a compensator 30 or in the event of a break in the power supply.

It will be noted that the device forming the subject of the invention makes it possible especially:

- not to increase the head losses in the cooling-gas recirculation circuit;
- not to disrupt the gas flow through the exchanger 28 during normal operation; and
- not to disturb the proper operation of the fan.

Of course, it remains to be stated that the present invention is not limited to the examples of embodiments described and/or shown but that it encompasses all the variants thereof which fall within the context of the scope of the appended claims.

What is claimed is:

1. Rapid-cooling oven, forming part of a plant comprising treatment stations, especially stations for the heat treatment of products in strip form, through which a metal strip runs continuously, the rapid cooling being obtained by spraying onto the strip a jet of atmosphere gas consisting of a nitrogen/hydrogen mixture having a hydrogen content which is greater than 15%, and preferably close to 50%, the atmosphere gas being recirculated using a circuit of recirculation ducts comprising at least one fan and at least one gas/water exchanger located in an enclosure, the various ducts comprising compensators made in the form of a series of corrugations allowing all the ducts to expand, wherein the enclosure, in which the exchanger or exchangers are housed and into which the atmosphere-gas recirculation ducts emerge, comprises:

a main flow area via which the cooling gas flows through the exchangers, this flow area being provided with a register upstream of the said exchanger or exchangers;

bypass flow areas allowing the flow of cooling gas to be diverted in the event of the main flow area being closed, so that this flow does not pass through the exchanger or exchangers, the bypass flow areas being provided with registers and actuators with a very short response time, i.e. of less than five seconds, these being tripped by means for detecting a break in the strip, a break in a compensator corrugation and a break in the power supply.

2. Oven according to claim 1, wherein the actuators of the pneumatic type are tripped by a sensor which detects any variation in the tension in the strip.

3. Oven according to claim 1, wherein the actuators are tripped by a sensor which detects any variation in the pressure in the rapid-cooling chamber.

4. Oven according to claim 1, wherein means are provided for tripping the actuators, which control the register provided in the main flow area, in the event of an interruption in the power supply so as to close the main flow area immediately, the bypass flow areas remaining closed.

5. Oven according to claim 4, wherein the means for tripping the actuators in the event of an interruption in the power supply are produced in the form of switches which trip by a break or fault in the current.

6. Oven according to claim 1 further comprising means for stopping the rotation of the fan in a very short time.

7. Oven according to claim 6, wherein the means allowing the rotation of the fan to stop in a very short time consists of means to couple it to a generator, to which it is coupled either in the event of a break in a corrugation of a compensator or in the event of a break in the power supply.

8. In an apparatus for rapidly cooling heat treated metal strips with a recirculating nitrogen-hydrogen cooling gas mixture having a hydrogen content which ranges between 15%–50%, and a recirculation circuit for the gas mixture having a fan for creating a flow though recirculation ducts connected, through expandable compensator corrugations, upstream to at least one gas/water exchanger, the exchanger comprising:

a housing having a main flow area upstream of the exchanger and into which recirculating cooling gas flows;

first register means interposed across the main flow area for selectively switching between open and closed states thereby passing or blocking flow through a major portion of the main flow area;

at least one bypass flow area within the housing and located adjacent the main flow area;

second register means interposed across the bypass flow area for selectively switching between open and closed states thereby passing or blocking flow through the bypass area;

means for respectively sensing a break in the strip or the corrugation, or an interruption of power to the fan; and actuator means for rapidly responding to a plurality of dangerous conditions for activating the sensing means and for switching the first and second registers in accordance with the particular dangerous conditions.

9. An apparatus according to claim 8, wherein the actuator means is of the pneumatic type, and is tripped by a sensor which detects any variation in the tension in the strip.

10. An apparatus according to claim 8, wherein the actuator means is tripped by a sensor which detects any variation in pressure in a rapid-cooling chamber where the strip is cooled.

11. An apparatus according to claim 8, wherein means are provided for tripping the actuator means, which controls the first register means provided in the main flow area, in the event of an interruption in the power supply so as to close the main flow area immediately, and wherein the bypass flow areas remain closed.

12. An apparatus according to claim 11, wherein the means for tripping the actuators in the event of an interruption in the power supply are produced in the form of switches which trip by a break or fault in the current.

13. An apparatus according to claim 8, further comprising means for stopping the rotation of the fan in a very short time.

14. An apparatus according to claim 13, wherein the means allowing the rotation of the fan to stop in a very short time comprises means to couple the fan to a generator, to which it is coupled either in the event of a break in a corrugation of the compensator or in the event of an interruption in the power supply.

* * * * *